US011692409B2

(12) United States Patent
Ingram et al.

(10) Patent No.: US 11,692,409 B2
(45) Date of Patent: Jul. 4, 2023

(54) GAP CONTROL FOR WIRELINE SHEAR RAMS

(71) Applicant: Baker Hughes Oilfield Operations LLC, Houston, TX (US)

(72) Inventors: Andrew Ingram, Houston, TX (US); Connor Cook, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 12 days.

(21) Appl. No.: 17/035,429

(22) Filed: Sep. 28, 2020

(65) Prior Publication Data

US 2022/0098952 A1 Mar. 31, 2022

(51) Int. Cl.
*E21B 33/06* (2006.01)

(52) U.S. Cl.
CPC ..... *E21B 33/063* (2013.01)

(58) Field of Classification Search
CPC ..... E21B 33/062; E21B 33/063; E21B 33/06; E21B 33/061
USPC ..... 251/1.1, 1.3
See application file for complete search history.

(56) References Cited

U.S. PATENT DOCUMENTS 4,081,027 A 3/1978 Nguyen
4,313,496 A * 2/1982 Childs ..... B23D 21/00 166/55
4,341,264 A 7/1982 Cox
4,347,898 A 9/1982 Jones
5,515,916 A * 5/1996 Haley ..... E21B 29/08 166/55
8,844,613 B2 9/2014 Shah
10,577,884 B2 3/2020 Trivedi
11,391,108 B2 * 7/2022 Urrutia ..... E21B 33/063
(Continued)

FOREIGN PATENT DOCUMENTS

CN 106639957 5/2017
WO 2019/199494 10/2019

OTHER PUBLICATIONS

Ryan Gustafson, "BOP shear ram built to meet BSEE's new wireline-cutting requirement," Baker Hughes, a GE Company, Aug. 29, 2019, https://www.drillingcontractor.org/bop-shear-ram-built-to-meet-bsees-new-wireline-cutting-requirement-53348, 3 pages.
(Continued)

*Primary Examiner* — Kevin F Murphy
*Assistant Examiner* — Jonathan J Waddy
(74) *Attorney, Agent, or Firm* — Hogan Lovells US LLP

(57) ABSTRACT

A shear ram system includes an upper block coupled to a first arm, the upper block positioned to transition from a first location outside a bore to a second location within the bore, the upper block including an upper blade having a cutout formed at a radially outward end, the cutout having a cutout profile. The shear ram system also includes a lower block coupled to a second arm, the lower block positioned to transition from the first location outside the bore to the second location within the bore, the lower block including a gap control arm including a wear insert arranged axially higher than a lower blade, the gap control arm having an arm profile that substantially conforms to the cutout profile. The wear insert of the gap control arm is configured to engage the cutout when the upper block and the lower block are moved to the second location.

18 Claims, 13 Drawing Sheets

(56) References Cited

U.S. PATENT DOCUMENTS

| | | | | |
|---|---|---|---|---|
| 2008/0001107 | A1* | 1/2008 | Gass | E21B 33/063 251/1.3 |
| 2013/0062540 | A1* | 3/2013 | Jurena | E21B 33/062 251/1.3 |
| 2014/0048245 | A1 | 2/2014 | Yendell | |
| 2016/0060995 | A1* | 3/2016 | Skeels | E21B 29/08 166/298 |
| 2016/0102518 | A1* | 4/2016 | Araujo | B65D 47/32 251/1.3 |
| 2019/0162040 | A1* | 5/2019 | Threadgill | E21B 33/063 |
| 2019/0309596 | A1 | 10/2019 | Baker | |
| 2022/0213757 | A1* | 7/2022 | Threadgill | E21B 33/063 |

OTHER PUBLICATIONS

International Search Report and Written Opinion dated Jan. 7, 2022 in corresponding PCT Application No. PCT/US2021/071599.

* cited by examiner

GAP CONTROL FOR WIRELINE SHEAR RAMS

BACKGROUND OF THE DISCLOSURE

1. Field of the Disclosure

This disclosure relates in general to oil and gas tools, and in particular, to systems and methods for shearing tubulars and/or wirelines.

2. Brief Description of Related Art

In oil and gas production, drilling and recovery may occur in high pressure environments where various tools may be utilized to control wellbore pressures. For example, a blowout preventer or the like may be arranged at an entrance to the wellbore. During operations, equipment may pass through the blowout preventer and, if necessary, the blowout preventer may be utilized to seal the wellbore to reduce the likelihood of uncontrolled releases from the wellbore. One component of the blowout preventer may be a shear ram. The shear ram may be a hydraulically driven component that drives cutting edges of two components toward one another to contact and shear the components therebetween, such as wirelines or piping. However, the shear rams may be subject to excessive stresses during operation, and as a result, may wear out quickly. Furthermore, it may be difficult to effectively shear large diameter piping while also maintaining shearing capabilities for wirelines.

SUMMARY OF THE DISCLOSURE

Applicants recognized the problems noted above herein and conceived and developed embodiments of systems and methods, according to the present disclosure, for shear rams.

In an embodiment, a shear ram system includes an upper block coupled to a first arm, the upper block positioned to transition from a first location outside a bore to a second location within the bore, the upper block including an upper blade having a cutout formed at a radially outward end, the cutout having a cutout profile. The shear ram system also includes a lower block coupled to a second arm, the lower block positioned to transition from the first location outside the bore to the second location within the bore, the lower block including a gap control arm including a wear insert arranged axially higher than a lower blade, the gap control arm having an arm profile that substantially conforms to the cutout profile. The wear insert of the gap control arm is configured to engage the cutout when the upper block and the lower block are moved to the second location.

In another embodiment, a wellhead includes a tubular fluidly coupled to a wellbore, the tubular having a bore, and a pressure control device positioned to extend into the bore. The pressure control device includes a lower carrier arranged proximate the bore in a first position and within the bore in a second position, the lower carrier including a gap control arm, the gap control arm arranged axially higher than a mounting base and including a recess configured to receive a removable wear insert. The pressure control device also includes a lower blade coupled to the lower carrier. The pressure control device further includes an upper carrier arranged proximate the bore in the first position and within the bore in the second position. The pressure control device also includes an upper blade coupled to the upper carrier, the upper blade including a cutout formed at a radially outward location relative to a cutting face of the upper blade, the cutout having a cutout profile configured to receive the gap control arm when the lower carrier and the upper carrier are in the second position.

In an embodiment, a blowout preventer includes a bore fluidly coupled to a wellbore and a pressure control device positioned to extend into the bore. The pressure control device includes an upper block coupled to a first arm, the upper block positioned to transition from a first location outside a bore to a second location within the bore, the upper block including an upper blade having a cutout formed at a radially outward end, the cutout having a cutout profile. The pressure control device also includes a lower block coupled to a second arm, the lower block positioned to transition from the first location outside the bore to the second location within the bore, the lower block including a gap control arm including a wear insert arranged axially higher than a lower blade, the gap control arm having an arm profile that substantially conforms to the cutout profile. The wear insert of the gap control arm is configured to engage the cutout when the upper block and the lower block are moved to the second location.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE PREFERRED EMBODIMENT

Figure 1:
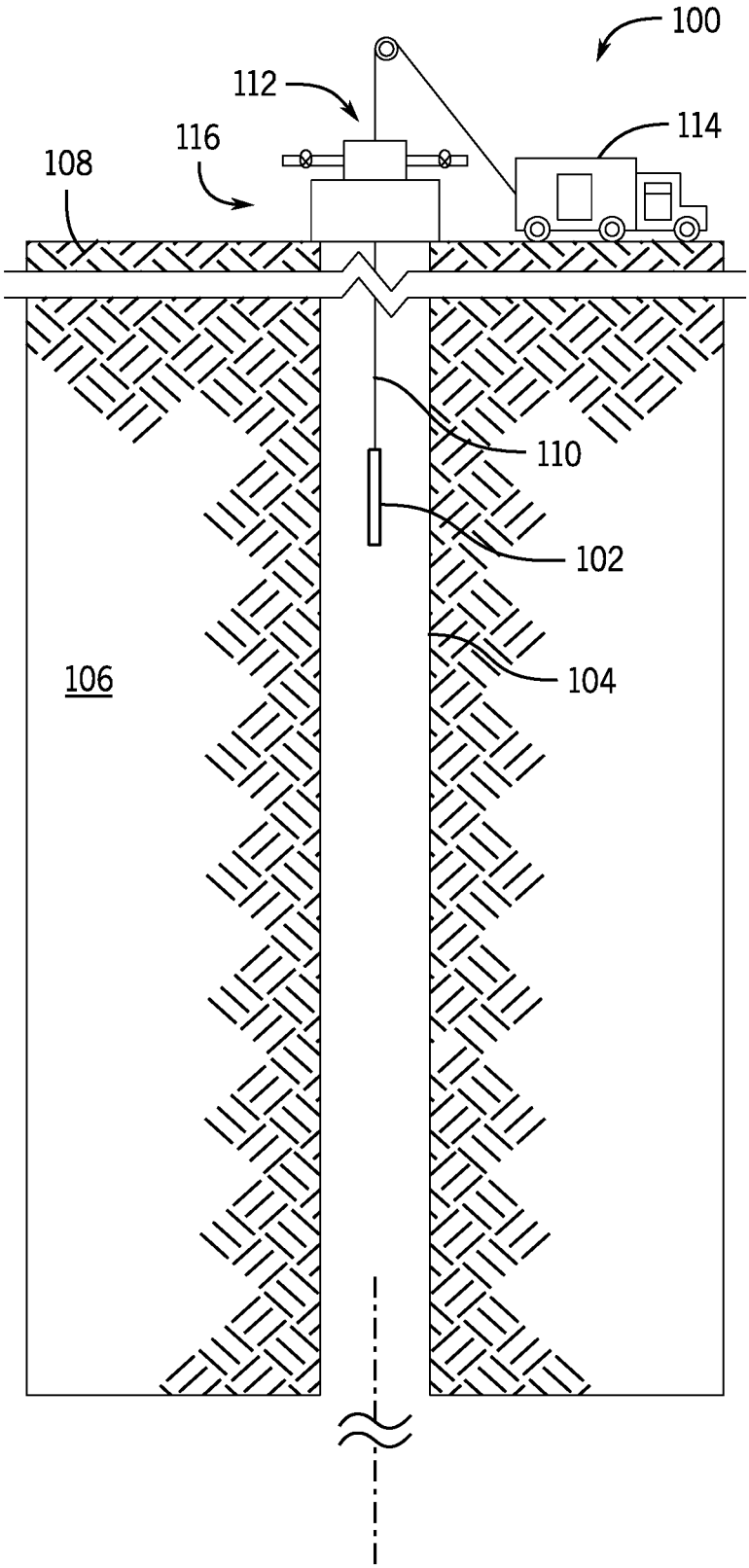
FIG. 1 is a side elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations. Furthermore, like numbers may be used for like components for simplicity, but such numbering is not intended to limit the disclosure. Moreover, it should be appreciated that various features from one or more embodiments depicted herein may be utilized across embodiments.

Embodiments of the present disclosure are directed toward a blowout preventer (BOP) shear ram system that may be utilized for both piping (e.g., tubulars, casing, tubing, etc.) and wirelines. Various embodiments present gap control arms, wear inserts, shear blade geometry, and shear ram geometry that enables shear rams of the shear ram system to shear pipe as well as wireline. As will be discussed herein, gap control arms may be provided on a lower carrier along with wear inserts that engage a removable blade attached to an upper carrier. However, it should be appreciated that various embodiments may provide the gap control arms and insert on the upper carrier for engagement of a removable blade attached to a lower carrier. Embodiments of the present disclosure may provide a robust system that enables improved maintenance operations by providing removable, replacement components at friction interfaces. Additionally, various embodiments may enable shearing of large diameter pipes while maintaining capabilities to shear wirelines.

Various embodiments of the present disclosure provide a gap control profile integrated directly into a removable, detachable component (e.g., a blade) such that gap control occurs between the block and the blade. Moreover, various embodiments may include use of two attachable and/or replaceable components to provide a gap control interface. For example, in various embodiments, a wear insert and a blade may form the interface. Advantageously, this configuration provides the ability to replace both interfacing parts to re-establish gap control after field use. Embodiments also provide blades that capture a full bore span to capture a wireline located at any position within the bore to enable successful shearing of the wireline. This may be accomplished even when omitting centralizers to capture wirelines located outside the blade span, however, it should be appreciated that embodiments of the present disclosure may also incorporate wirelines.

As will be described below, in various embodiments, a gap control arm profile may substantially conform to a cutout formed in a blade opposite the gap control arm. Accordingly, interfacing may occur between the respective profiles, which may both include replaceable parts at the primary friction interfaces, thereby improving maintenance operations and potentially increasing a useful life of the system as a whole. In various embodiments, the system provides capabilities for full bore span cutting of the pipe such that the cutting surfaces of the blades are positioned substantially within the gap control arms and the cutouts. Additionally, various embodiments include a stepped geometry of the cutout that enables a close fit then opposing blades are brought together while also maintaining a cutting interface between the replaceable components.

FIG. 1 is a schematic side view of an embodiment of a wellbore system 100 that includes a tool 102 (which may be part of a tool string) being lowered into a wellbore 104 formed in a formation 106 from a surface location 108. The illustrated wellbore system 100 may be referred to as a wireline system because the tool 102 is conveyed on a cable 110, such as an electric wireline. It should be appreciated that the wireline system is shown for illustrative purposes and that embodiments of the present disclosure may also be utilized in other applications where tubulars are extended into the wellbore 104. In various embodiments, the electric wireline may transmit electric signals and/or energy from the surface location 108 into the wellbore, for example to provide operational power for the tool 102 and/or to transmit data, such as data obtained from sensors arranged on the tool 102. In various embodiments, the tool 102 may be utilized to perform downhole logging operations, such as an imaging tool, a resistivity tool, a nuclear tool, or any other logging tool that may be used in a downhole environment.

The wellbore system 100 includes a wellhead assembly 112, shown at an opening of the wellbore 104, to provide pressure control of the wellbore 104 and allow for passage of equipment into the wellbore 104, such as the cable 110 and the tool 102. In this example, the cable 110 is a wireline being spooled from a service truck 114. The wellhead assembly 112 may include a blowout preventer (BOP) 116 (e.g., pressure control device) that comprises shear rams that may be utilized to shear components extending through BOP 116. As will be described below, in various embodiments the shear rams may be energized to move from a position outside of a bore of the BOP 116 to a position within the bore of the BOP 116. The shear rams may cut the cable 110 in the illustrated embodiment to thereby facilitate closure of the wellbore 104. Furthermore, it should be appreciated that the shear rams may also shear the drill pipe, casing, shear subs or combinations of pipe, control lines, tubing, hoses, and/or wireline. Accordingly, references to shearing only one of a pipe or a wireline are not intended to limit the scope of the present disclosure, as it should be appreciated that embodiments may enable shearing of multiple different components utilizing the features described herein. While FIG. 1 is illustrated as a surface operation, it should further be appreciated that various embodiments of the present disclosure may also be integrated into other applications, such as subsea or offshore applications. For example, embodiments may be integrated into a BOP stack positioned at a sea floor.

Figure 2:
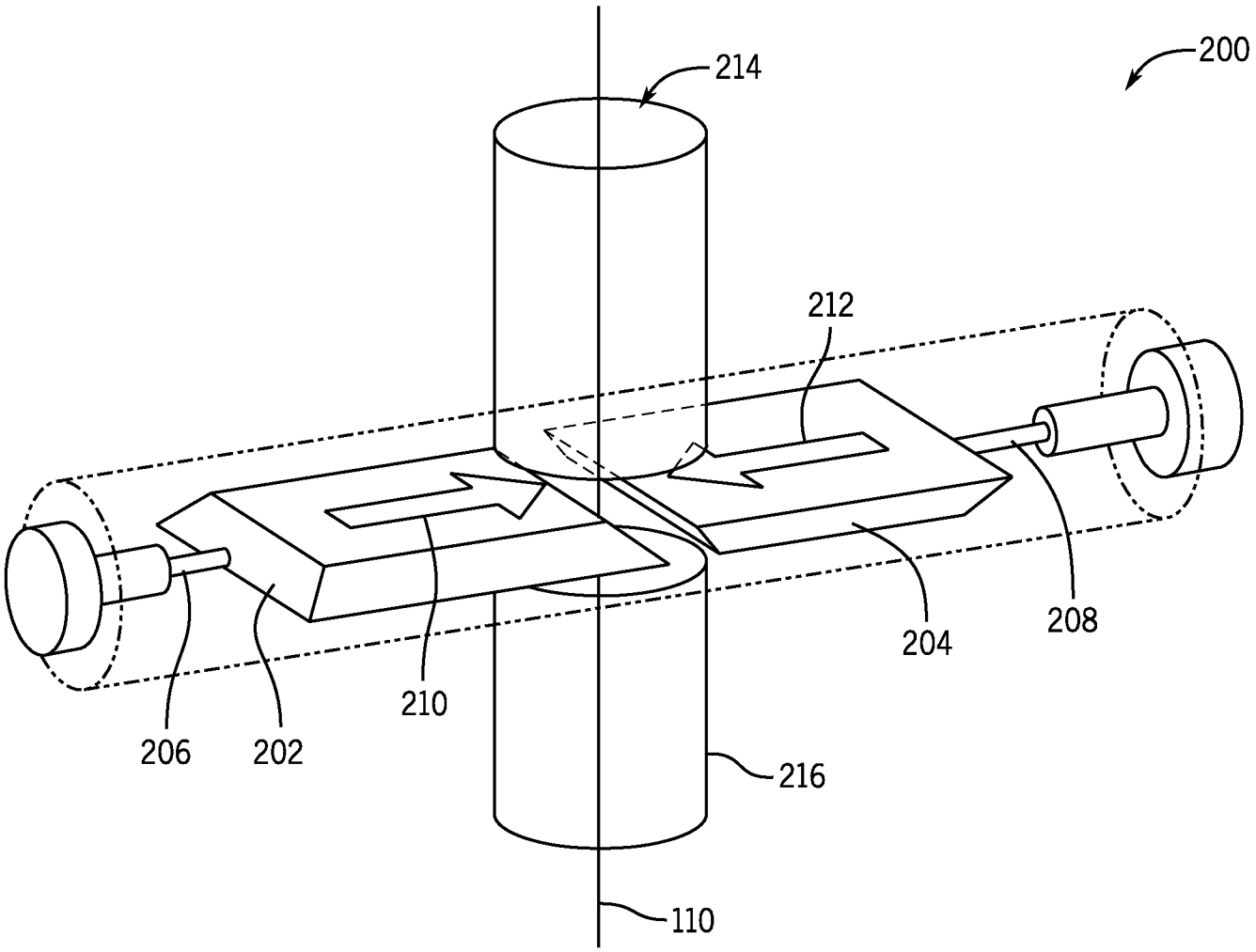
FIG. 2 is a schematic perspective view of an embodiment of a shear ram system, in accordance with embodiments of the present disclosure.

FIG. 2 is a schematic isometric view of an embodiment of a shear ram system 200 (e.g., pressure control device), which may be incorporated into or associated with a BOP (for example BOP 116). In the illustrated embodiment, the shear ram system 200 includes a pair of shear rams 202, 204. The shear rams 202, 204 may be referred to as an upper block and lower block, respectively. Each of the shear rams 202, 204 is coupled to arms 206, 208 that facilitate radial movement of the rams 202, 204 in a first direction 210 and a second direction 212. In operation, the rams may be arranged outside a bore 214 of a wellbore tubular 216, which may be part of the BOP, and when activated may extend into the bore 214. In the illustrated embodiment, the cable 110, which may be a wireline, is arranged within the bore 214. It should be appreciated that the cable 110 may be positioned within another tubular, such as a casing or the like, also extending through the bore 214. As will be described below, embodiments of the present disclosure may facilitate shearing the cable 110 along with other tubulars positioned within the bore 214.

Figure 3:
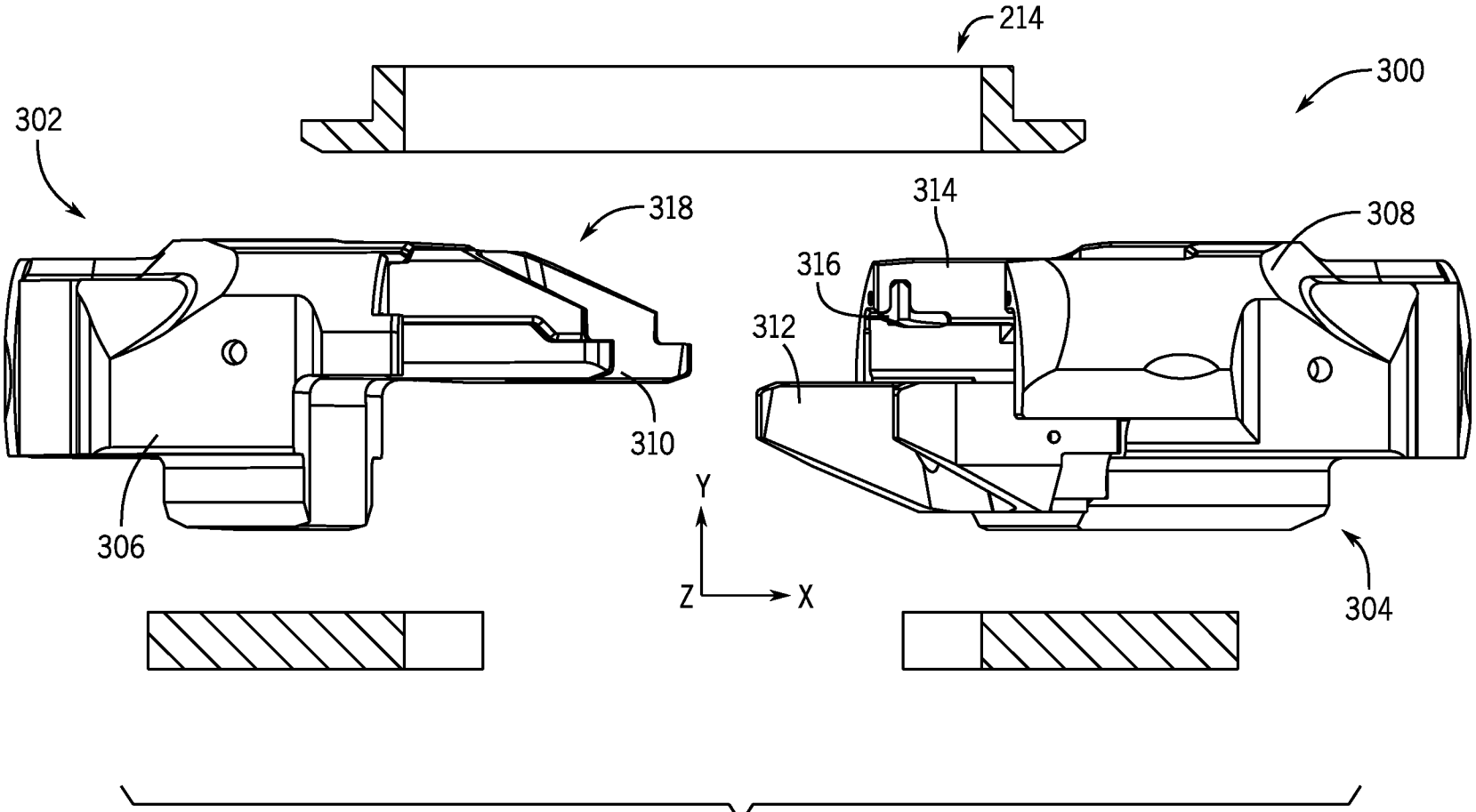
FIG. 3 is a side elevational view of an embodiment of a shear ram system, in accordance with embodiments of the present disclosure.

FIG. 3 is a schematic side view of an embodiment of a shear ram system 300, which may be included within a BOP or other pressure control device associated with a wellbore, as described above. The illustrated shear ram system 300 is positioned extending at least partially into the bore 214 and includes an upper block 302 and a lower block 304, which may also be referred to as rams. In the illustrated embodiment, the upper block 302 and the lower block 304 are rams. As would be appreciated by one skilled in the art, a shear ram may operate to shear and/or sever a component within a wellbore. While embodiments described herein may refer to a shear ram, it should be appreciated that other rams, such as a pipe ram or dual offset ram, may also be utilized.

In various embodiments, each of the upper and lower blocks 302, 304 may be formed from one or more components coupled together. By way of example, an upper carrier 306 (e.g. upper block carrier) and a lower carrier 308 (e.g., lower block carrier) may receive an upper blade 310 and a lower blade 312, respectively. In various embodiments, the blades 310, 312 are coupled to the carriers 306, 308 via fasteners or the like, and as a result, may be removable components that can be decoupled and replaced after one or more operational cycles. For example, the blades 310, 312 may dull, and as a result, it may be desirable to replace the blades 310, 312. While the illustrated configuration includes the removable components, it should be appreciated that other embodiments may include an integrated carrier and blade without the fasteners. Moreover, in embodiments, one of the rams may include removable components while the other is integrated.

In the illustrated embodiment, the lower carrier 308 includes gap control arms 314 on each side. The gap control arms 314 may be formed within a body portion of the lower carrier 308, for example by one or more machining processes at a particularly selected location. In this example, the gap control arms are arranged radially outward from the lower blade 312, however, it should be appreciated that at least a portion of gap control arms 314 may overlap at least a portion of the lower blade 312. However, in other embodiments, there may not be overlap between the gap control arms 314 and the lower blade 314. As will be described, a wear insert 316 may be removably coupled to each of the gap control arms 314, for example via a fastener. The wear insert 316 may be utilized with a mating cutting surface in order to facilitate cutting of both tubulars and wireline. It should be appreciated that in various embodiments the wear insert 316 may also be integrally formed into the gap control arms 314, such to form a single replaceable part. That is, the wear insert 316 may be a portion of the gap control arms 314 that includes a different metal, surface treatment, or the like that is integrally formed and replaceable along with the gap control arms 314. For example, the wear insert 316 may be press fit to the gap control arms 314.

In various embodiments, the upper blade 310 includes a cutout 318, which is represented as a profile that will be described in more detail herein. The cutout 318 may be substantially aligned with the wear insert 316 (e.g., with the gap control arms 314) such that in operation the wear insert 316 contacts and engages the cutout 318. This configuration may enable the blades to remain together and/or close enough to shear the wireline while also enabling shearing of a tubular within the bore 214.

Figure 4:
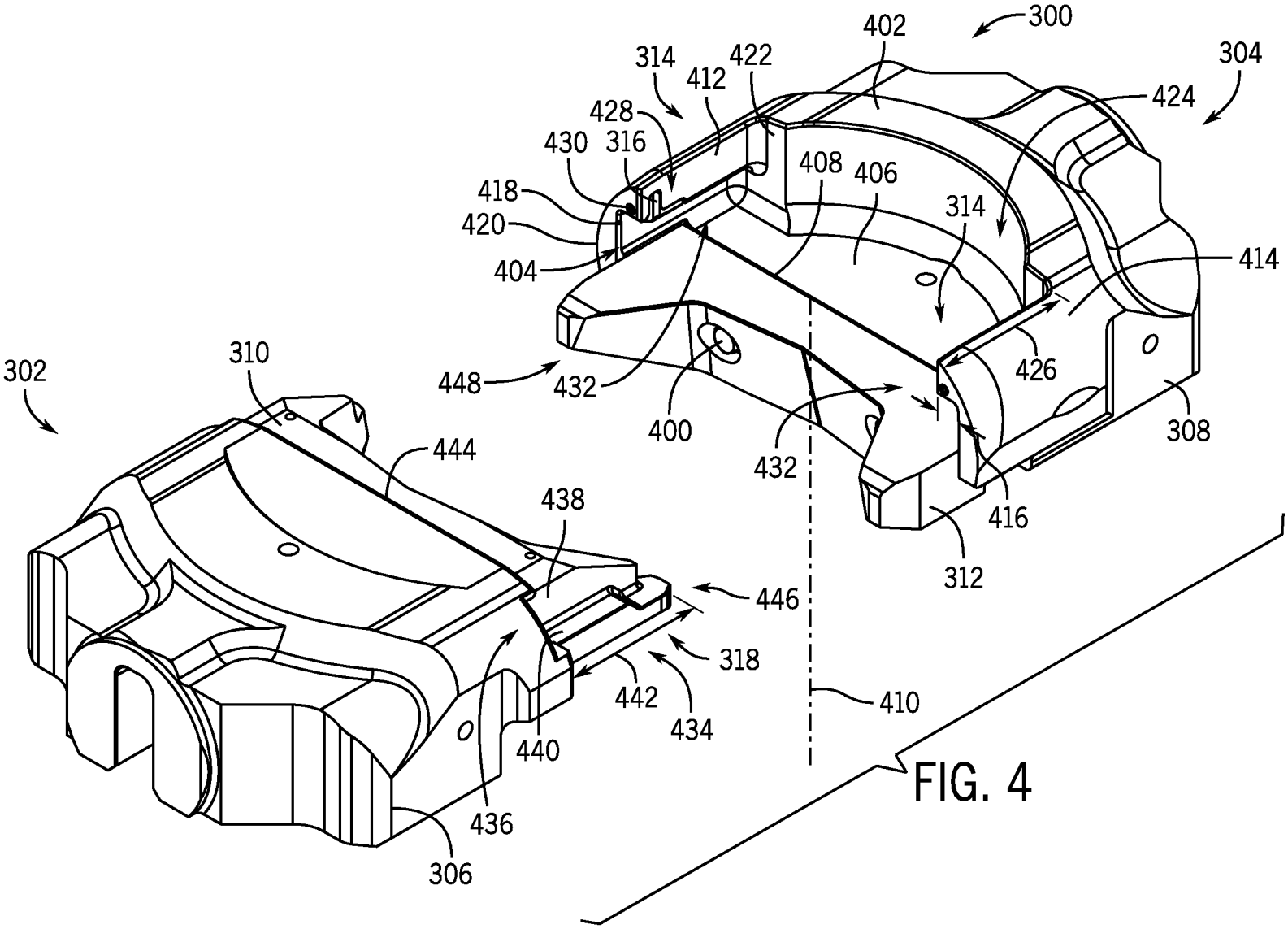
FIG. 4 is a perspective view of an embodiment of a shear ram system, in accordance with embodiments of the present disclosure.

FIG. 4 is a perspective view of the shear ram system 300 illustrating the upper block 302 and the lower block 304, including the carriers 306, 308 and the blades 310, 312. As noted, the blades 310, 312 are each attached to the respective carriers 306, 308 via one or more connectors, such as fasteners 400. However, it should be appreciated that various other coupling mechanisms may be utilized to attach the blades 310, 312 to the carriers 306, 308. Moreover, as indicated, in various embodiments the blades 310, 312 may be integrally formed into the carriers 306, 308. In various embodiments, removability of the blades 310, 312 may be desirable to enable repair and or replacement during maintenance operations. Removability of the blades 310, 312 may provide certain advantages, as described herein, such as rapid replacement in the field. Furthermore, blade adjustments may enable unique tolerance cases, for example, by including blades with different dimensions. Additionally, in various embodiments, blade with different cutting profiles may also be incorporated and removability would enable replacements and adjustments to the cutting profiles easily and rapidly while in the field.

The illustrated lower carrier 308 includes the gap control arms 314 arranged axially higher than the lower blade 312. That is, with respect to the bore 214 (FIG. 3), the gap control arms 314 are further uphole than the lower blade 312 in the illustrated embodiment. The gap control arms 314 are formed integral to a body 402 of the lower carrier 308 and a void 404 separates the gap control arms 314 from a mounting base 406. As will be described below, the void 404 receives at least a portion of the upper blade 310, which may facilitate operation of the BOP. The mounting base 406 includes a vertical mounting surface 408 (e.g., a mounting interface) that receives and supports the lower blade 312. As noted above, vertical is used as a relative term to describe the current orientation of FIG. 4, and it should be appreciated that in various embodiments the mounting surface 408 may include one or more slants or ridges to facilitate securing the lower blade 312 to the lower carrier 308.

The illustrated gap control arms 314 extend inward toward a carrier axis 410, such that an inner arm surface 412 is closer to the carrier axis 410 than an outer arm surface 414, which may form at least a portion of an outer diameter of the lower carrier 308. An arm thickness 416 is illustrated as extending between the inner arm surface 412 and a lower carrier inner surface 418. It should be appreciated that the arm thickness 416 may be particularly selected based on one or more operating conditions of the system. For example, certain conditions, such as high pressures or thicker tubulars, may lead to thicker arms, while other conditions may facilitate thinner arms.

In the illustrated embodiment, the gap control arms 314 extend a gap control arm length 426 from a lower carrier face 420 to a lower carrier wall 422, which forms at least part of a pocket 424 that may receive at least a portion of the upper blade 310 and/or the upper carrier 306. In this example, the inner arm surface 412 is substantially planar and constant across the gap control arm length 426, but it should be appreciated that in other embodiments the inner arm surface 412 may be variable along the length 426. By way of example, the inner arm surface 412 may include a slant or a step that may increase or decrease a local thickness 416. It should be appreciated that these features may be particularly selected based on anticipated operating conditions. Additionally, the inner arm surface 412 may not be substantially vertical, but may be slanted inwardly toward the axis 310, may be curved or arced, or any other reasonable shape.

The gap control arm 314 also includes a recess 428 for receiving the wear insert 316, which in this example is secured to the gap control arm 314 via an insert fastener 430. In various embodiments, the wear insert 316 may be considered a loose fit or a gapped fit component, where the insert fastener 430 enables minor movement of the wear insert 316 within the recess 428. As used herein, minor may refer to movement within a tolerance range, such as approximately 5-10% of a length of the recess and/or approximately 10-20% of a diameter of the fastener 430, among other potential ranges. As will be described below, an engagement surface of the wear insert 316 may move axially along the axis 410 responsive to external forces, where the insert fastener 430 enables this movement while maintaining the wear insert 316 position within the recess 428. That is, a contact force may drive the wear insert 316 axially upward (e.g., away from the mounting base 406).

The gap control arm 314 includes an arm profile 432 that may be particularly selected to conform to and interface with the cutout 318 (e.g., gap control cutout) formed on the upper blade 310. In this example, the upper blade 310 includes the cutout 318 at radially outward portions 434 of the upper blade 310, each of the cutouts 318 being aligned with respective gap control arms 314 of the lower carrier 308. Accordingly, in operation, as the upper blade 310 and the lower blade 312 move toward one another, the upper blade 310 will interface with the lower carrier 308. Specifically, the cutout 318 will interface with the wear insert 316 and/or the gap control arms 314.

In this example, the cutout 318 includes a cutout profile 436 that substantially conforms to the arm profile 432, and in this example includes a cutout wall 438 and a cutout surface 440. The illustrated cutout wall 438 is substantially vertical and arranged substantially perpendicular to the cutout surface 440, but it should be appreciated that this configuration is for illustrative purposes only and, in various embodiments, the wall 438 and/or surface 440 may be slanted or have a variable profile in order to interface with the arm profile 432. The cutout 318 spans for a cutout length 442, extending from an upper carrier mounting surface 444 to an end 446 of the upper blade 310. It should be appreciated that the cutout 318 and various dimensions thereof may be particularly selected based on expected operating conditions, as described with respect to features of the gap control arms 314 as well.

As noted above, various embodiments include the blades 310, 312 that capture the full bore. To facilitate operation of the blades 310, 312, lead in tapers 448 may be included. As shown, the lead in tapers 448 are inwardly sloped toward the axis 410 and may be utilized to capture wireline within the bore.

Figure 5:
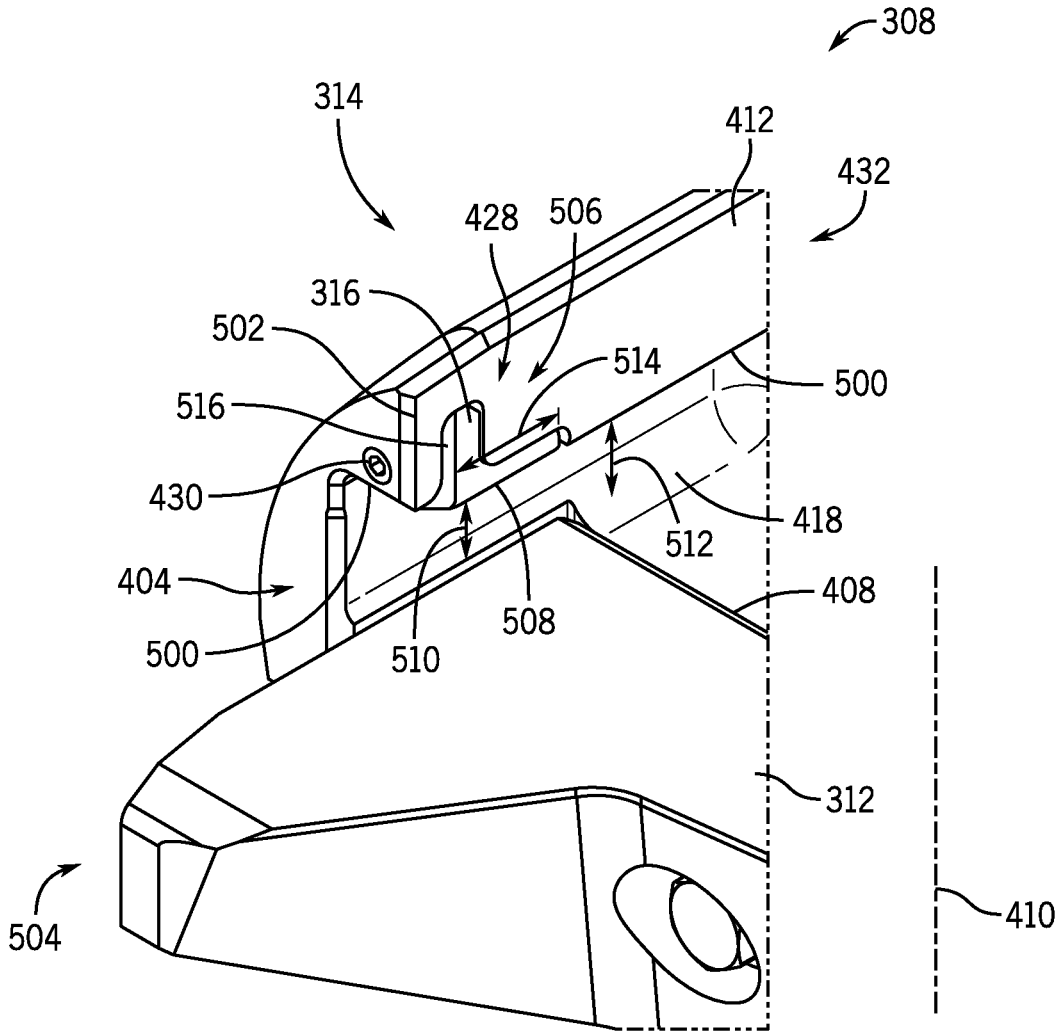
FIG. 5 is a partial perspective view of an embodiment of a gap control arm with a wear insert, in accordance with embodiments of the present disclosure.

FIG. 5 is a perspective view of an embodiment of the lower carrier 308 and the lower blade 312. This view further illustrates the gap control arm 314 including the wear insert 316 arranged within the recess 428. As noted above, in various embodiments, the wear insert 316 is secured to the lower carrier 308 via the insert fastener 430, which is a set screw in this example but may include various pins, bolts, clips, and the like.

In this example, the void 404 separates the lower blade 312 from the gap control arm 314. The gap control arm 314 in this configuration extends beyond the mounting surface 408 to at least partially overlap the lower blade 312. The arm profile 432 is also illustrated as including a planar contact surface 500 along with the inner arm surface 412, which is illustrated as being substantially vertical and/or approximately perpendicular to the planar contact surface 500, but as noted above, may include various slants, contours, or the like. A leading edge 502 is arranged in front of the recess 428. In other words, the leading edge 502 provides a separation such that the leading edge 502 is closer to an end 504 of the lower blade 312. The illustrated recess 428 includes a recess profile 506 particularly shaped to conform to the wear insert 316. As noted above, the fit between the recess 428 and the wear insert 316 may be loose such that axial and/or lateral movement of the wear insert 316 is enabled at least to an extent (e.g., within a threshold tolerance).

As shown in FIG. 5, the wear insert 316 includes an insert contact surface 508 that extends lower than the planar contact surface 500. However, it should be appreciated that the insert contact surface 508 may be substantially flush with the planar contact surface 500 or recessed with respect to the planar contact surface 500. Moreover, in various embodiments, the insert contact surface 508 may be lower than the planar contact surface 500 in an inactivated position, but upon interaction with the cutout 318, may be shifted to be substantially flush with the planar contact surface 500. In this configuration, an insert contact surface height 510 may be less than a planar contact surface height 512. It should be appreciated that references to the "higher" and "lower" surfaces are with respect to the orientation shown in FIG. 5. As an example, in embodiments that are inverted (e.g., the gap control arms 314 and wear inserts 316 arranged on the upper carrier), it should be understood that if the gap control arms 314 were on the lower carrier the wear insert contact surface 308 will be higher than the gap control contact surface 300. It should be appreciated that the wear insert 316 may be particularly selected to be a replaceable, wearable component that is designed to wear out or otherwise undergo maintenance earlier than the lower carrier 308. The illustrated insert contact surface 508 extends for an insert length 514 that is at least a portion of the arm length 426, but it should be appreciated that the specific dimensions may be particularly selected based on operating conditions. Furthermore, the wear insert 316 may be formed from a different material from the lower carrier 308. For example, the wear insert 316 may be formed from a softer metal.

The wear insert 316 illustrated in FIG. 5 may not be aligned with the inner surface 412. For example, the wear insert 316 may include a vertical insert extension 516 that is offset or otherwise recessed into the recess 428 such that the inner surface 412 extends further inward toward the axis 410 than the vertical insert extension 516. However, it should be also be appreciated that in other embodiments the inner surface 412 and the vertical insert extension 516 may be substantially aligned. Moreover, it should further be understood that various surfaces and edges shown in FIG. 5 and elsewhere herein may include chamfers, bevels, fillets, J grooves, and the like. In operation, as the lower carrier 308 and upper carrier 306 move toward one another, the wear insert 316 may be positioned to contact the cutout 318 to maintain the gap control between rams, thereby enabling cutting of other tubulars and cables, such as wirelines.

Figure 6:
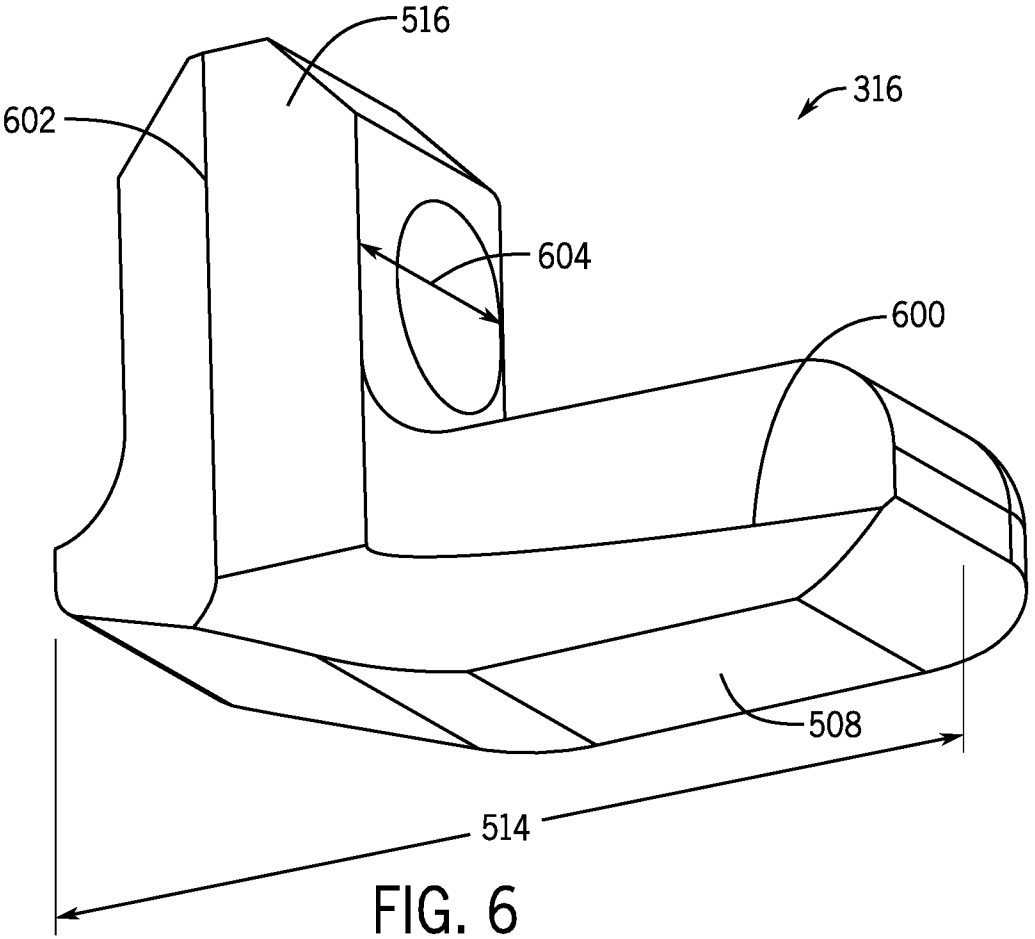
FIG. 6 is a perspective view of an embodiment of a wear insert, in accordance with embodiments of the present disclosure.

FIG. 6 is a perspective view of an embodiment of the wear insert 316. In this example, the wear insert 316 is substantially "J-shaped" or "boot shaped," but it should be appreciated that the wear insert 316 may be a variety of different shapes that correspond to the recess 428. For example, the wear insert 316 may be "T-shaped" or "U-shaped" or any other reasonable shape. This example illustrates the insert contact surface 508 and the vertical insert extension 516. Furthermore, the illustrated insert length 514 is shown, with the vertical insert extension 516 being closer to one end than the other. As noted, this configuration is for illustrated purposes and various positions of the components and their respective dimensions may be adjusted based on expected operating conditions.

In this example, a lateral ridge 600 and a vertical ridge 602 are shown along the length 514 and the vertical insert extension 516, respectively. These ridges 600, 602 may represent change in an insert thickness 604. As noted above, the thickness 604 may be variable at different locations such that the wear insert 316 may not be flush with the inner arm surface 412. It should be appreciated that these features may be particularly selected based on operating conditions and the like, and moreover, the ridges 600, 602 may be pointed, curved, or any other reasonable shape. Furthermore, the ridges 600, 602 may be replaced by gaps or valleys.

Figure 7:
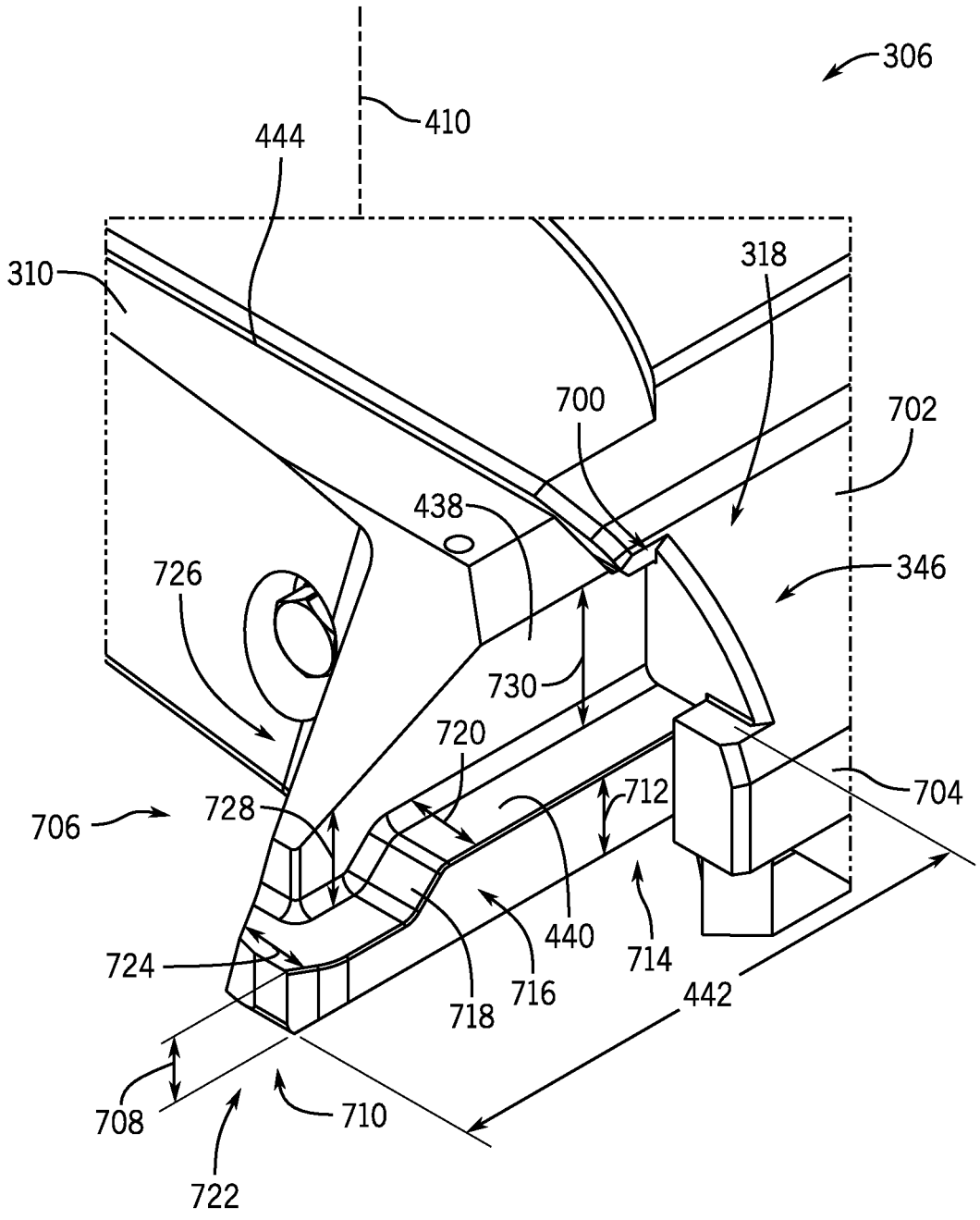
FIG. 7 is a perspective view of an embodiment of a cutout formed in an upper blade, in accordance with embodiments of the present disclosure.

FIG. 7 is a perspective view of an embodiment of the cutout 318 formed on the upper blade 310. In this example, the upper blade 310 is coupled to the upper carrier 306 at the upper carrier mounting surface 444. It should be appreciated that the overlapping portion 700 of the upper carrier mounting surface 444 is provided for illustrative purposes and in other embodiments the overlapping portion 700 may be omitted. Furthermore, in other embodiments, the upper carrier mounting surface 444 may include various apertures and/or extensions for engaging the upper blade 310. In this example, the upper carrier 306 includes a body portion 702 with a stabilizing arm 704 arranged outward from the upper blade 310 (e.g., radially outward from the axis 410). The stabilizing arm 704 may block lateral movement of the upper blade 310 and provide guidance for where to mount the upper blade 310, but it should be appreciated that various configurations may omit or alter the stabilizing arm 704. Moreover, the stabilizing arm 704 may include an additional aperture for fastening the upper blade 310 to the upper carrier 306.

As described above, the cutout 318 includes the cutout profile 436, which may substantially correspond to the arm profile 432 and/or to at least a portion of the wear insert 316 to facilitate contact between the components. In this example, the cutout 318 includes a variable cutout thickness 706 where a leading thickness 708 at a first region 710 is less than a trailing thickness 712 at a second region 714. In this example, leading refers to the cutting edge and/or the portion that will interact with the lower carrier 308 first. A transition 716 is positioned between the first region 710 and the second region 714 and includes a sloped surface 718. It should be appreciated that the configuration of the cutout 318 may also be referred to as having a stepped geometry. In operation, the first region 710, the second region 714, and/or the transition 716 may interact with the wear insert 316 and/or the gap control arm 314 to facilitate cutting operations. For example, in certain embodiments, the first region 710 is stepped down to allow blade deflection when shearing larger diameter tubulars, without driving shear force loads into the wear insert 316 and gap control arms 314. The transition 716 and the second region 714 may be selected to ensure the blade gap will be controlled when both blade shearing edges/interfaces are engaging the wireline, while minimizing the amount of shear force loading imparted on the wear insert 316 and gap control arms 314 during shearing of tubulars. It should be appreciated that "minimizing" the shear force refers to a process to reduce or substantially redirect shearing forces from the wear insert 316 and/or the gap control arms 314. As an example, minimizing the shear force may correspond to reducing the shear forces applied to the wear insert 316 and/or the gap control arms 314 by a threshold amount or percentage, such as a shear force reduction of approximately 10% to 50%, among other options.

As noted above, the illustrated embodiment includes the cutout profile 436 with the cutout wall 438 positioned substantially perpendicular to the cutout surface 440. In this example, a contour is positioned at a transition between the wall 438 and the surface 440, but as described above, various other transitions may be included. The surface 440 extends a surface width 720 along most of the cutout length 442, however, at a tip 722 a tip width 724 is larger than the surface width 720. This configuration is for illustrative purposes and it should be appreciated that the tip 722 may be omitted in various embodiments, however, the tip 722 and increased tip width 724 may improve alignment such that the wear insert 316 may be captured at the tip 722 and directed along the cutout 318.

The illustrated embodiment further shows a variable wall height 726, where a leading wall height 728 is less than a trailing wall height 730, in accordance with the variable thickness described above.

Figure 8:
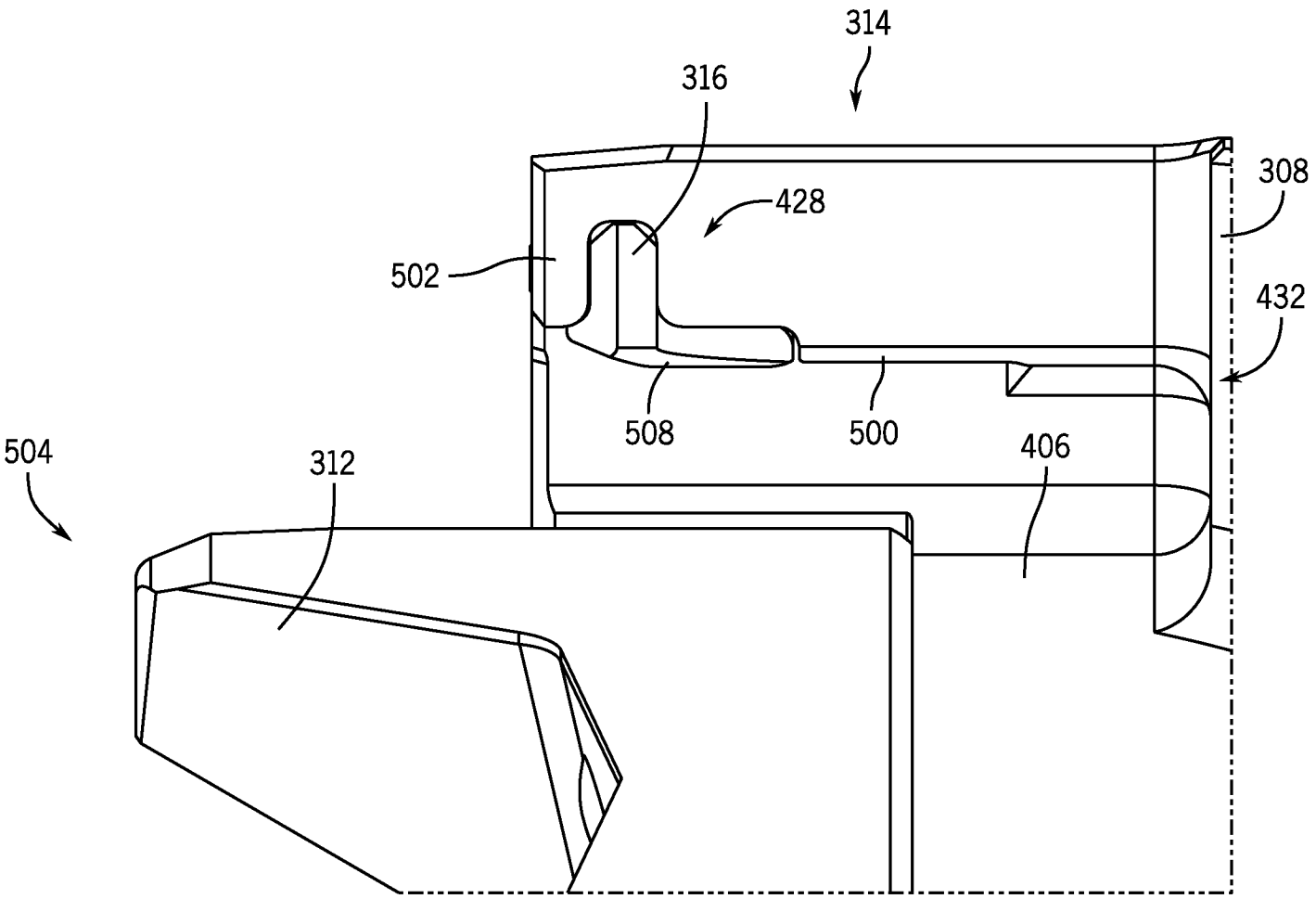
FIG. 8 is a side view of an embodiment of a gap control arm with a wear insert, in accordance with embodiments of the present disclosure.

FIG. 8 is a side view of the gap control arm 314 positioned proximate the lower blade 312 coupled to the lower carrier 308. As described above, the illustrated embodiment includes the arm profile 432 having the planar contact surface 500 and the insert contact surface 508. The illustrated configuration shows the loose fit arrangement of the wear insert 316, where minor movement is enabled within the recess 428. In this configuration, at least a portion of the wear insert 316 is arranged axially lower (e.g., closer to the mounting base 406) than the planar contact surface 500. Furthermore, the leading edge 502 is shown laterally forward of the wear insert 316 (e.g., closer to the end 504 of the lower blade 312.

Figure 9:
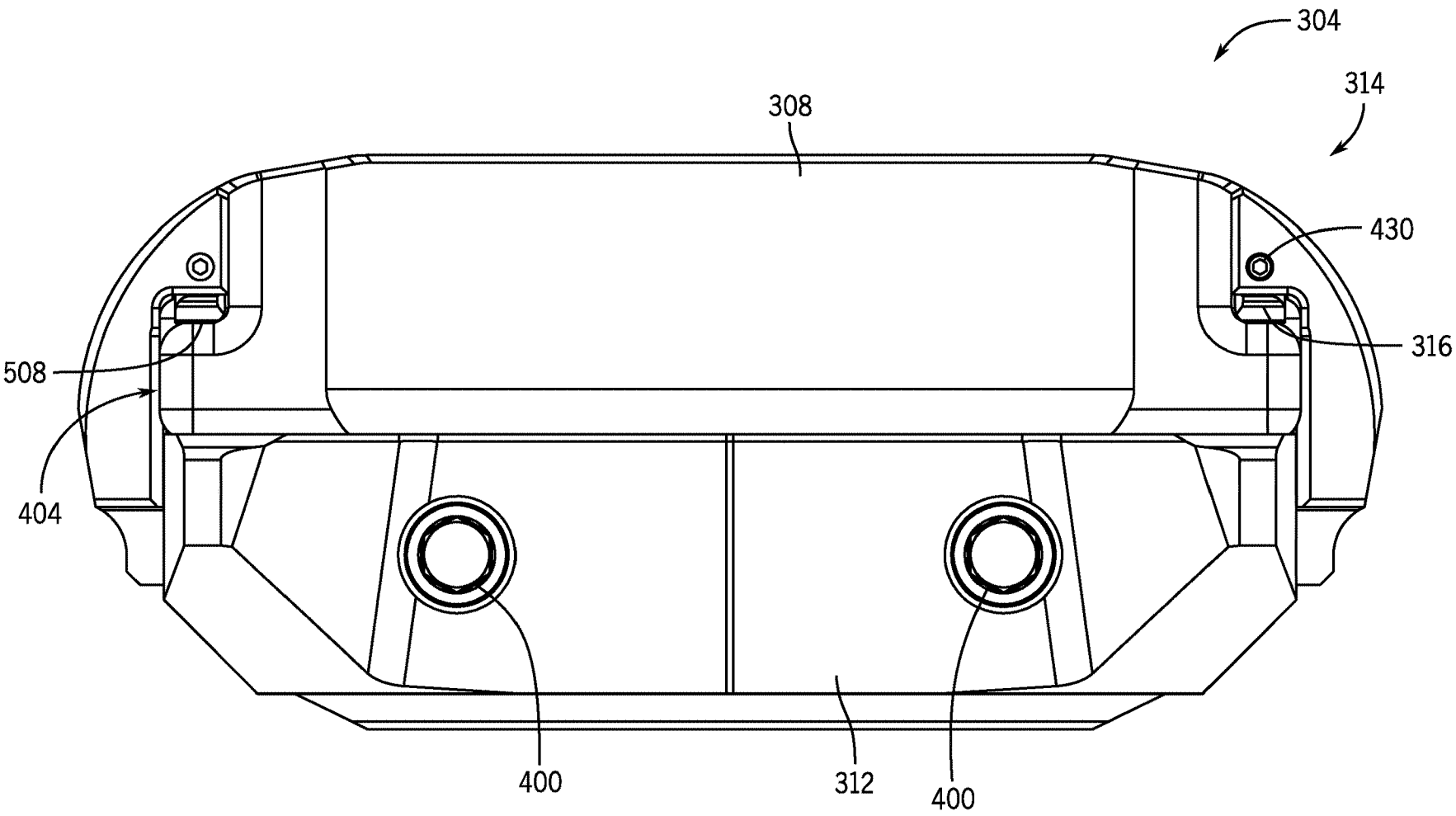
FIG. 9 is a front view of an embodiment of a lower block, in accordance with embodiments of the present disclosure.

FIG. 9 is a front view of the lower block 304. In this example, the lower blade 312 is coupled to the lower carrier 308 via the fasteners 400. It should be appreciated that while two fasteners 400 are shown in this example, more or fewer fasteners may be utilized. Moreover, embodiments of the present disclosure are not limited to only threaded fasteners. By way of example, clips, studs, and the like may also be utilized to secure the lower blade 312 to the lower carrier 308.

Further illustrated in FIG. 9 is the lower axial arrangement of the insert contact surface 508 compared to the planar contact surface 500. Such an arrangement enables the wear insert 316 to make first contact with the opposing upper blade 310, thereby concentrating friction along the wear insert 316, which as noted above is a removable, replaceable component. Accordingly, operational costs may be reduced by focusing replacement and repair on removable components, such as the wear insert 316 and the upper blade 310, as opposed to larger and more expensive components, such as the carriers 306, 308. In operation, the void 404 will receive the upper blade 310 and provides gap control to keep the position of the blades close together. Furthermore, the arrangement still enables full pipe width for the blades 310, 312, enabling larger diameter pipes to be severed while still providing capabilities for severing wireline.

Figure 10:
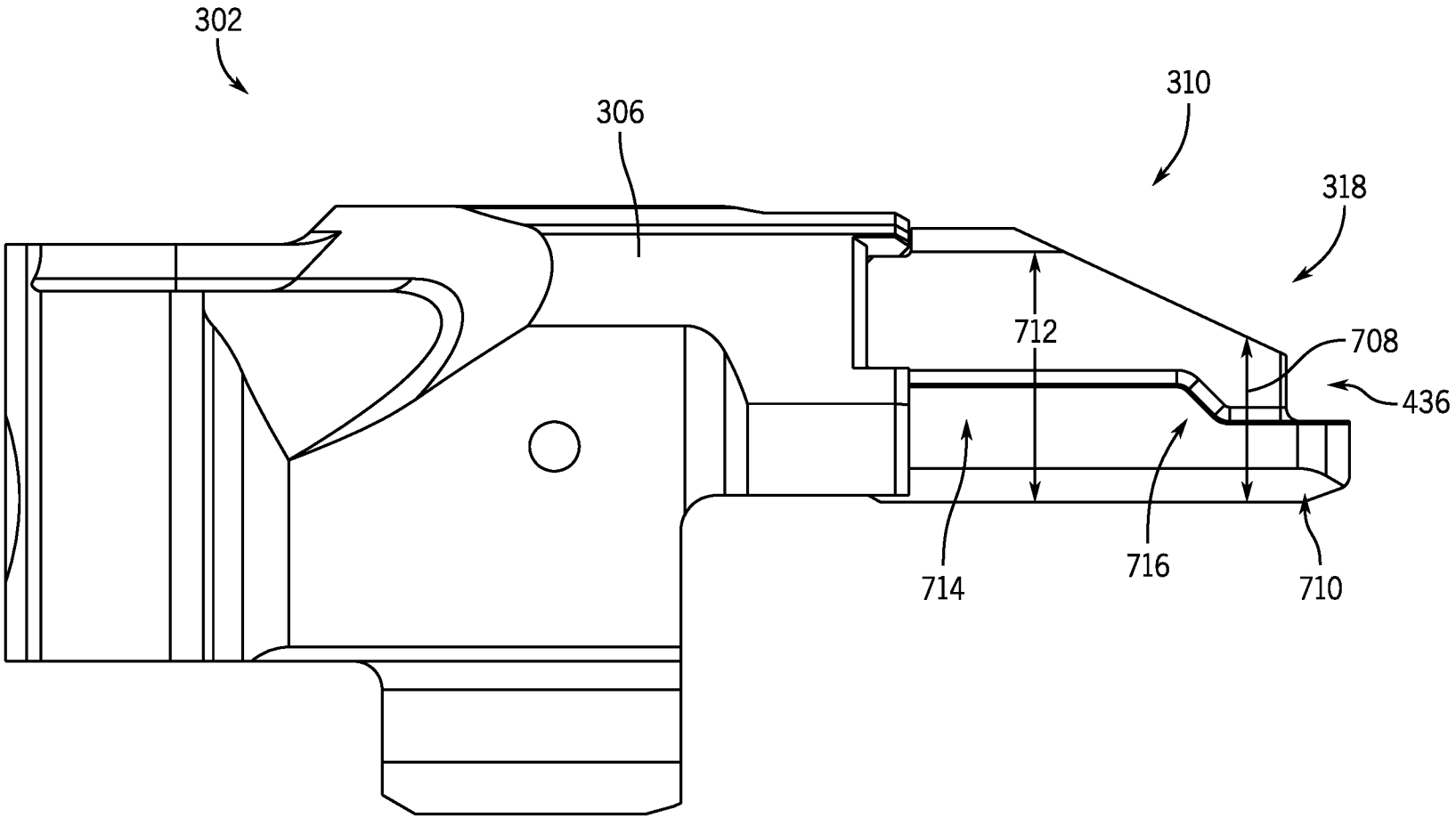
FIG. 10 is a side view of an embodiment of a cut out formed in an upper blade, in accordance with embodiments of the present disclosure.

FIG. 10 is a side view of the cutout 318 positioned along the lower blade. As noted above, the cutout 318 includes the cutout profile 436, which may be referred to as a geometrically stepped profile due to the elevational change between the first region 710 and the second region 714. In this example, the sloped transition 716 provides a change between the regions 710, 714, illustrated at least in part by the change in thicknesses 708, 712 of the associated regions. This configuration may substantially conform to the arm profile 432, thereby providing a close fit to facilitate cutting operations.

In this example, the cutout 318 is formed in the upper blade 310, which as noted above is a removable, replaceable part. Accordingly, damage to the upper blade 310 and/or the cutout 318 may be easily replaced, for example by removing the fasteners 400, rather than replacing or machining entire components such as the upper carrier 306.

Figure 11:
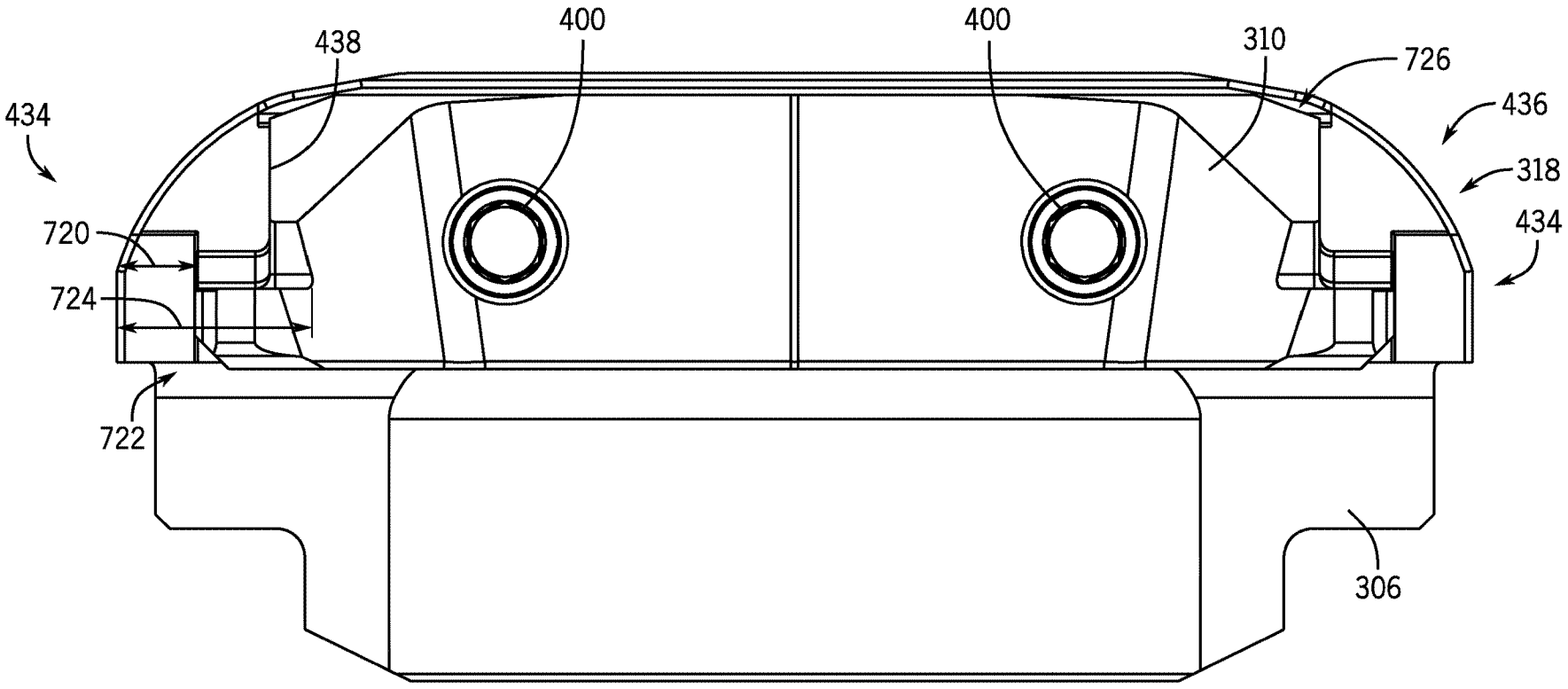
FIG. 11 is a front view of an embodiment of an upper block, in accordance with embodiments of the present disclosure.

FIG. 11 is a front view of the upper block 302 illustrating the cutouts 318 formed along the outer edges 434 of the upper blade 310. In this embodiment, the cutouts 318 are formed outward of the cutting surface of the upper blade 310. Additionally, in this example, configuring the system for full wellbore capture may reduce or eliminate the need for centralizers. The tip 722 is illustrated with the variable width where the tip width 724 is larger than the surface width 720 due to the wall 438. Moreover, the variable wall height 726 is illustrated in accordance with the changing profile 436.

Figure 12:
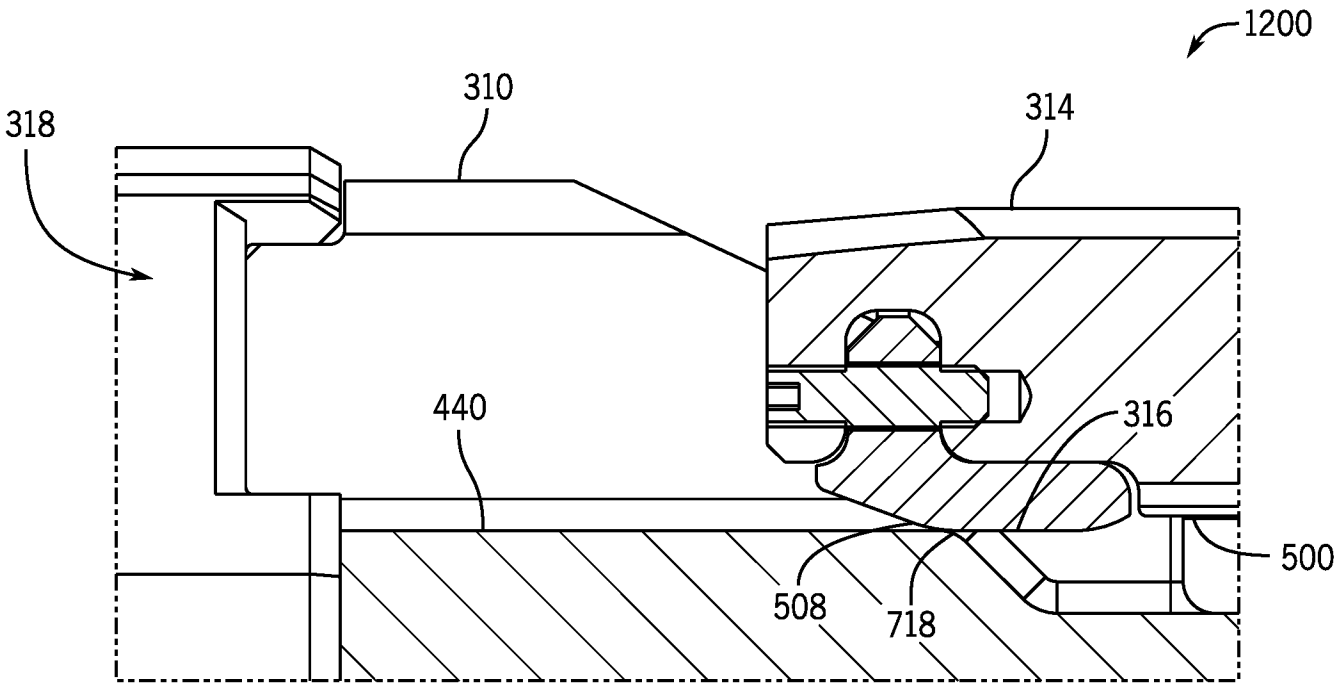
FIG. 12 is a line drawing of an embodiment of an operational condition of an upper block and a lower block, in accordance with embodiments of the present disclosure.

FIG. 12 is a line diagram of an embodiment of an operating condition 1200 illustrating an interface between the gap control arm 314 and the cutout 318. In this example, the upper block 302 and the lower block 304 are moving toward one another to drive the blades 310, 312 together to sever a tubular and/or wireline. The illustrated example shows the interaction between the gap control arm 314, which is arranged axially higher than the cutout 318. In this example, first contact is made via the wear insert 316. It should be appreciated that in certain embodiments the gap control arm 314 may make first contact and/or make substantially simultaneous contact in various embodiments. As shown, the insert contact surface 508 engages the cutout surface 440, specifically the sloped surface 718 in this example. It may be desirable to focus frictional contact interfaces on easily replaceable components, such as the wear insert 316 and the upper blade 310, as shown in FIG. 12, in order to reduce operating costs or to simplify maintenance operations.

Figure 13:
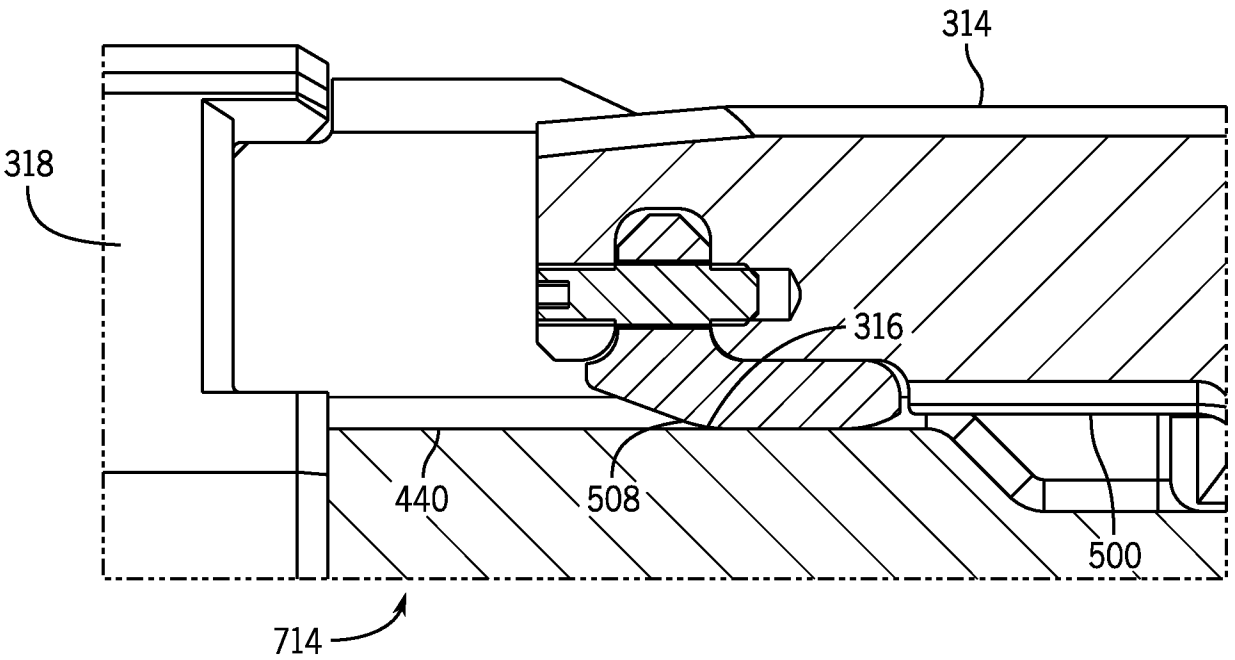
FIG. 13 is a line drawing of an embodiment of an operational condition of an upper block and a lower block, in accordance with embodiments of the present disclosure.

FIG. 13 is a line diagram of an embodiment of the operating condition 1200 illustrating the interface between the gap control arm 314 and the cutout 318. This continuation of movement of the upper block 302 and the lower block 304 toward one another shows contact between the insert contact surface 508 and the second region 714. Additionally, the variable height associated with the planar contact surface 500 may substantially conform to the variable cutout profile 436, thereby providing a close fit between the components, which in certain embodiments may also include contact between the gap control 314 and the lower blade 312. It should be appreciated that, in various embodiments, the wear insert 316 may or may not contact the upper blade 310 at the end of the ram stroke.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A shear ram system, comprising:

an upper block coupled to a first arm, the upper block positioned to transition from a first location outside a bore to a second location within the bore, the upper block comprising an upper blade having a cutout formed at a radially outward end, the cutout having a cutout profile;

a lower block coupled to a second arm, the lower block positioned to transition from the first location outside the bore to the second location within the bore, the lower block comprising a gap control arm including a removable wear insert secured via a wear insert fastener arranged axially higher than a lower blade, the gap control arm having an arm profile that conforms to the cutout profile and at least a portion of the gap control arm overlaps at least a portion of the lower blade;

wherein the wear insert of the gap control arm is configured to engage the cutout when the upper block and the lower block are moved to the second location.

2. The shear ram system of claim 1, wherein the cutout profile is a geometrically stepped profile having a variable thickness along a cutout length.

3. The shear ram system of claim 1, wherein a planar contact surface of the gap control arm is axially higher than an insert contact surface of the wear insert.

4. The shear ram system of claim 1, wherein each of the upper blade and lower blade are removably coupled to the respective upper block and lower block.

5. The shear ram system of claim 1, wherein the gap control arm further comprises:

a recess for receiving the wear insert, the recess including a recess profile that corresponds to the wear insert.

6. The shear ram system of claim 1, further comprising:

a second cutout formed at a second radially outward end of the upper blade, the second cutout positioned opposite the cutout; and a second gap control arm with a second wear insert, the second gap control arm positioned opposite the gap control arm;

wherein the cutout is aligned with the gap control arm and the second cutout is aligned with the second gap control arm.

7. The shear ram system of claim 1, wherein both the cutout and the gap control arm are arranged radially outward from a full bore span of a tubular positioned between the upper block and the lower block.

8. The shear ram system of claim 1, wherein at least a portion of the cutout overlaps at least a portion of the lower blade at the second location.

9. A blowout preventer, comprising:

a bore fluidly coupled to a wellbore; and a pressure control device positioned to extend into the bore, the pressure control device comprising:

an upper block coupled to a first arm, the upper block positioned to transition from a first location outside the bore to a second location within the bore, the upper block comprising an upper blade having a cutout formed at a radially outward end, the cutout having a cutout profile;

a lower block coupled to a second arm, the lower block positioned to transition from the first location outside the bore to the second location within the bore, the lower block comprising a gap control arm including a removable wear insert secured via a wear insert fastener and arranged axially higher than a lower blade, the gap control arm having an arm profile that conforms to the cutout profile;

wherein the wear insert of the gap control arm is configured to engage the cutout when the upper block and the lower block are moved to the second location and at least a portion of the gap control arm overlaps the lower blade, the portion including the wear insert.

10. The shear ram system of claim 9, wherein the cutout profile is a geometrically stepped profile having a variable thickness along a cutout length.

11. The shear ram system of claim 9, wherein a planar contact surface of the gap control arm is axially higher than an insert contact surface of the wear insert.

12. A wellhead, comprising:

a tubular fluidly coupled to a wellbore, the tubular having a bore; and a pressure control device positioned to extend into the bore, the pressure control device comprising:

a lower carrier arranged proximate the bore in a first position and within the bore in a second position, the lower carrier comprising a gap control arm, the gap control arm arranged axially higher than a mounting base and including a recess configured to receive a removable wear insert secured via a wear insert fastener;

a lower blade coupled to the lower carrier;

an upper carrier arranged proximate the bore in the first position and within the bore in the second position; and an upper blade coupled to the upper carrier, the upper blade comprising a cutout formed at a radially outward location relative to a cutting face of the upper blade, the cutout having a cutout profile configured to receive the gap control arm when the lower carrier and the upper carrier are in the second position, wherein the wear insert contacts the upper blade before the gap control arm when the upper carrier and lower carrier move to the second position.

13. The wellhead of claim 12, wherein the wear insert comprises:

an insert contact surface, extending for an insert length, the insert contact surface configured to extend axially outward from the recess; and a vertical insert extension.

14. The wellhead of claim 12, wherein the cutout profile comprises:

a geometrically stepped profile having a variable thickness along a cutout length.

15. The wellhead of claim 14, wherein the geometrically stepped profile includes a transition having a sloped surface positioned to engage at least a portion of the wear insert as the upper carrier and lower carrier move to the second position.

16. The wellhead of claim 12, wherein the upper blade is a removable component coupled to the upper carrier via a fastener.

17. The wellhead of claim 12, wherein the pressure control device is configured to shear pipe and to cut wireline.

18. The wellhead of claim 12, wherein at least a portion of the gap control arm overlaps the lower blade, the portion including the wear insert.

* * * * *